US006991205B2

(12) United States Patent
Myers et al.

(10) Patent No.: US 6,991,205 B2
(45) Date of Patent: Jan. 31, 2006

(54) TEXTURED BRICK WALL FORM PANEL

(75) Inventors: Dallas E. Myers, Middletown, OH (US); James W. Jackson, Middletown, OH (US)

(73) Assignee: Feather Lite Innovations, Inc., Springboro, OH (US)

( * ) Notice: Subject to any disclaimer, the term of this patent is extended or adjusted under 35 U.S.C. 154(b) by 0 days.

(21) Appl. No.: 10/770,777

(22) Filed: Feb. 3, 2004

(65) Prior Publication Data

US 2004/0217254 A1 Nov. 4, 2004

Related U.S. Application Data

(60) Provisional application No. 60/444,460, filed on Feb. 3, 2003.

(51) Int. Cl.
*E04G 9/06* (2006.01)
*E04G 9/10* (2006.01)

(52) U.S. Cl. ..... 249/16; 249/196

(58) Field of Classification Search ..... 249/15, 249/16, 189, 33, 47, 192, 196
See application file for complete search history.

(56) References Cited

U.S. PATENT DOCUMENTS 854,098 A * 5/1907 Mann ..... 249/16
969,248 A * 9/1910 David et al. ..... 249/15
1,123,261 A 1/1915 Edison
1,470,835 A * 10/1923 Hathaway ..... 249/15
1,776,999 A 9/1930 Jensen
1,963,985 A * 6/1934 Garrett ..... 249/190
3,307,822 A 3/1967 Stout
3,549,115 A 12/1970 Williams
3,661,354 A * 5/1972 Dagiel et al. ..... 249/192
3,899,155 A 8/1975 Ward
4,407,480 A 10/1983 Trimmer et al.
4,557,779 A * 12/1985 Bower et al. ..... 264/220
4,693,445 A * 9/1987 Sprecace-Pantoli ..... 249/189

* cited by examiner

*Primary Examiner*—Michael Safavi
(74) *Attorney, Agent, or Firm*—Wood, Herron & Evans, LLP

(57) ABSTRACT

A concrete form has an embossed panel for molding a facade of brickwork in a particular pattern on a concrete wall or the like. Specially constructed support beams, struts and flanges are secured to the panel on the back of the panel to prevent undesired deformation of the borders. Each flange has a panel engaging surface and a plurality of projections on the surface adapted to be received within depressions in the borders presented by the brickwork pattern. The panel is embossed to resemble a brickwork pattern, and the marginal borders vertically traverse the pattern through vertically aligned joints in alternate courses, the flanges having similarly arranged projections to be received within the spaced depressions presented by the aligned, vertically spaced joints.

21 Claims, 5 Drawing Sheets

TEXTURED BRICK WALL FORM PANEL

This claims the benefit of U.S. Provisional Patent Application Ser. No. 60/444,460, filed Feb. 3, 2003 and hereby incorporated by reference in its entirety.

BACKGROUND OF THE INVENTION

This invention relates generally to poured concrete wall forms and, more particularly, to panels coupled together and used to construct the concrete wall form to produce a textured facade on the poured concrete wall.

Prefabricated, reusable panels are often used to construct a wall form for a poured concrete wall. Typically, two spaced opposed parallel sets of forms are erected and concrete is poured there between to form a wall. Each form is constructed of a number of adjacent interconnected panels. Form ties are used to maintain the spacing between the opposed forms constructed of the panels.

These panels are necessarily of relatively high strength, yet preferably they are compact and lightweight to effect savings in handling, transportation, and storage. Hence, the panels are commonly constructed at least in part of lightweight metal such as aluminum and have a reinforcing grid secured to the back side of the panel for providing the necessary strength to resist buckling under the weight of the poured concrete.

Typically, the grid on each panel has a marginal frame projecting rearwardly from the panel to include a flange along the spaced side edges of the panel. The flanges are adapted to be positioned in an abutting relationship with the flange of an adjacent panel to construct the concrete wall form. Holes in the flanges of the adjacent panels can be aligned to receive there through the shank of a pin or a bolt. The pin or bolt may pass through the ends of the ties and commonly are held in position by wedges which are driven through a slot in the shank of the pin or bolt. As the wedges are driven into the slot, the abutting flanges of the adjacent panels are drawn together. The pins and wedges offer a simple mechanism for effectively coupling the panels together.

When the concrete is poured between the spaced forms and assembled panels, the hydrostatic forces generated by the poured concrete tend to spread the opposed forms apart, but these outward or spreading forces are held in check by the form ties. In addition, the concrete expands as it sets creating greater spreading forces on the panels. The pin joining the adjacent panels together is subject to significant pulling forces by the form tie and an opposed force by the frame or rail on the panel.

Recently, such panels are commonly embossed with various designs to produce a decorative facade on the concrete wall formed by the panels. Thus, panels are available having a bat and board pattern to resemble the exterior walls of a conventional frame house, a ribbed pattern to resemble aluminum sliding or the like, and a smooth brick pattern to resemble brickwork construction. Examples of such wall form panels are shown in U.S. Pat. Nos. 1,776,999; 3,307,822; 3,549,115; and 4,407,480, each of which is hereby incorporated by reference in its entirety.

Panels which include an embossed or otherwise formed design to produce a decorative facade on the concrete wall optimally should produce a concrete wall facade as realistic as possible. In many known concrete wall form panels having a textured brick or other pattern, the pattern design is marred with blemishes or other marks inconsistent with the desired appearance. For example, the reinforcing grid or frame on the back surface of each panel is often spot welded to the back face of the embossed or textured face sheet of the panel. The spot welding naturally being produced at high temperatures produces a pock mark on the embossed surface of the panel. Such pock marks are typically inconsistent with the embossed pattern and produce a corresponding blemish or mark on the facade of the poured concrete wall. Obviously, such pock marks detract from the aesthetic appeal of the decorative facade on the concrete wall formed by such panels.

Notwithstanding the problems of producing realistic and aesthetic designs as discussed above, an additional problem common to all of the panel sections having a masonry type pattern embossed therein is that of damage to the panel and particularly the vertical marginal borders of the panels. In this regard, it is absolutely critical that these vertical marginal borders maintain their initial configuration inasmuch as the shape of the marginal borders influences the continuity in a wall formed by a plurality of form sections arranged side by side. For example, when the embossed pattern resembles smooth brickwork in an English cross-bond (joints between stretchers in one course positioned mid-length of stretchers in adjacent courses) the vertical edges of each panel traverse the pattern in such a manner as to present "half-bricks" in alternating courses along the vertical marginal borders of the sections. Thus, when sections so constructed are arranged side by side it is extremely important that the respective marginal borders match up exactly with their "half-bricks" precisely aligned to present a continuous full brick and hence, maintain the continuity of the brickwork pattern. However, in practice it has been found that panel sections having a brickwork pattern as previously described often become deformed along the vertical marginal borders thereof after only a few uses such that subsequent use of the form results in an unsightly discontinuous facade on the poured concrete wall produced by the section.

An additional problem with known panels of this type is the tendency for the panels to accumulate concrete. By their very nature, panels of this type have an irregular and non-planar face sheet. The configuration of the face sheet presents many openings, pockets, channels or grooves along the marginal edges of the face sheet adjacent the grid or flanges on the back face of the panel. When such panels are used to construct a poured concrete wall, the fluid concrete often finds its way into the openings, pockets, channels or grooves between the face sheet and the grid or flanges. When that concrete hardens or cures, it is permanently embedded in the panel and significantly increases the weight of the panel. Moreover, such embedded concrete often promotes separation or peeling of the face sheet from the grid or flanges ultimately resulting in damage to the panel and requiring disposal of the equipment.

Accordingly, it is apparent that there is a need to provide a panel section having a textured pattern embossed therein that produces a blemish-free, realistic facade while maintaining the structurally robust, compact and lightweight characteristics desirable in such panels.

SUMMARY OF THE INVENTION

These and other objectives of the invention have been attained by a textured wall form panel for a poured concrete wall. The panel, according to a presently preferred embodiment of this invention, includes an embossed aluminum face sheet that has a textured pattern such as a masonry or brick facade. The panel includes a frame or grid projecting rearwardly on the panel and, advantageously, the frame is welded along the entire height of the side flanges to the face sheet. As such, the strength of the resulting panel is significantly increased. Likewise, the contour of the front edges of the side flanges corresponds to that of the embossed face sheet. In one presently preferred embodiment, the embossed pattern resembles smooth brickwork in an English cross-bond pattern such that each panel edge terminates with every other brick being a half brick. The frame edges are contoured to correspond to the textured or embossed pattern thereby increasing strength of the panel in those regions.

Moreover, the grid or frame on the rear of the panel includes at least one and typically a pair of vertical interior beams which extend the entire height of the panel thereby providing increased strength and robust construction. However, the vertical interior beams are not welded directly to the embossed face sheet thereby avoiding weld marks on the embossed pattern which would then result in blemishes on a poured concrete wall. The grid or frame on the back of the panel also includes a number of spaced generally horizontal struts which likewise enhance the structural integrity of the panel. Advantageously, each of the struts or hat sections is sized and configured to be seated within the representative mortar joints in the embossed or textured configuration of the face sheet. In one embodiment, the shape of the terminal edges of the struts are configured to mate with the contour of the representative mortar joints on the face sheet.

As such, the profile of the grid and associated struts is reduced providing for a more compact and manageable panel without sacrificing structural integrity or strength. Likewise, any blemishes or marks resulting from the welding of the struts to the face sheet are concealed within the mortar joint portion between the courses of bricks represented in the poured concrete wall facade. As such, blemishes and unsightly pock marks are concealed in the resulting poured concrete wall.

Additionally, the holes in the side flanges of the grid through which the pin and wedge assemblies project to secure a pair of adjacent panels together are reinforced with flared bushings to provide for a more robust and stronger panel and associated connection scheme. Moreover, the openings, pockets, channels or grooves along the marginal edges of the face sheet adjacent the grid or frame members are filled with plugs or portions of the frame members to prevent the entry of mortar therein.

As a result, this invention provides a panel section having a textured pattern embossed therein that produces a blemish free, realistic facade while maintaining structurally robust, compact and light weight characteristics desirable in concrete wall form panels.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
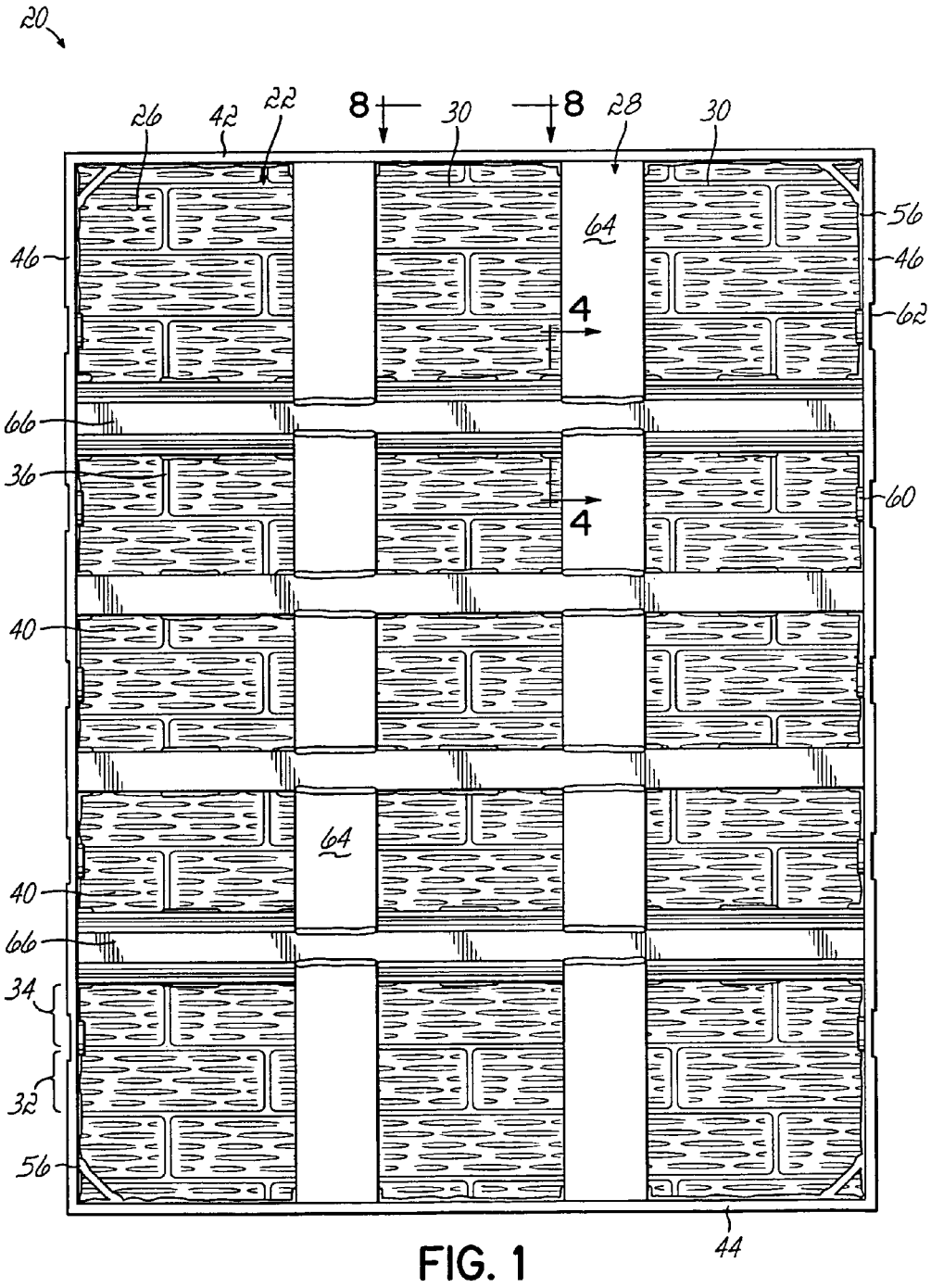
FIG. 1 is a view of the back side of a concrete wall form panel according to a presently preferred embodiment of this invention.
Figure 2:
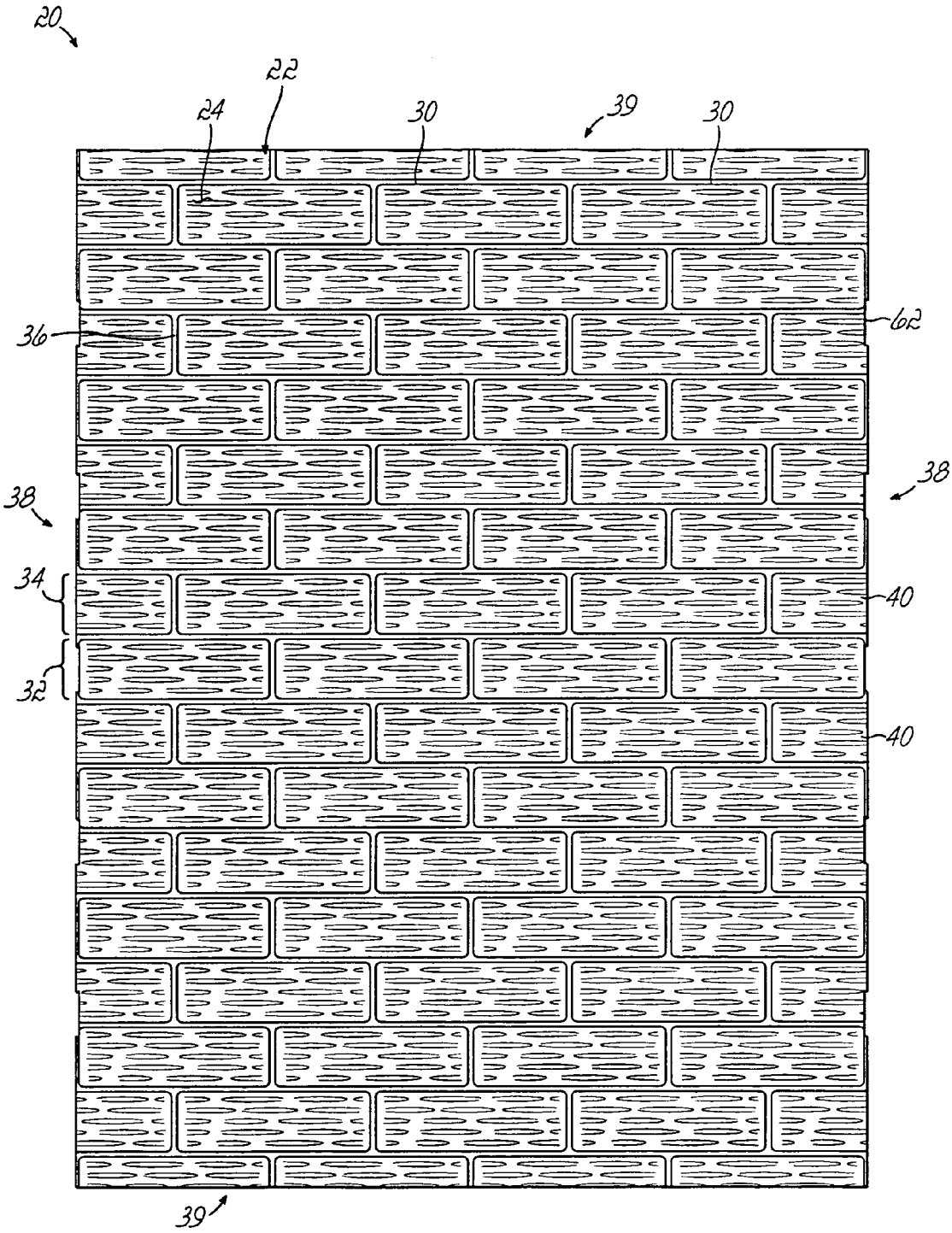
FIG. 2 is a view of the front face of the panel of FIG. 1 showing the textured surface of the face sheet of the panel.
Figure 3:
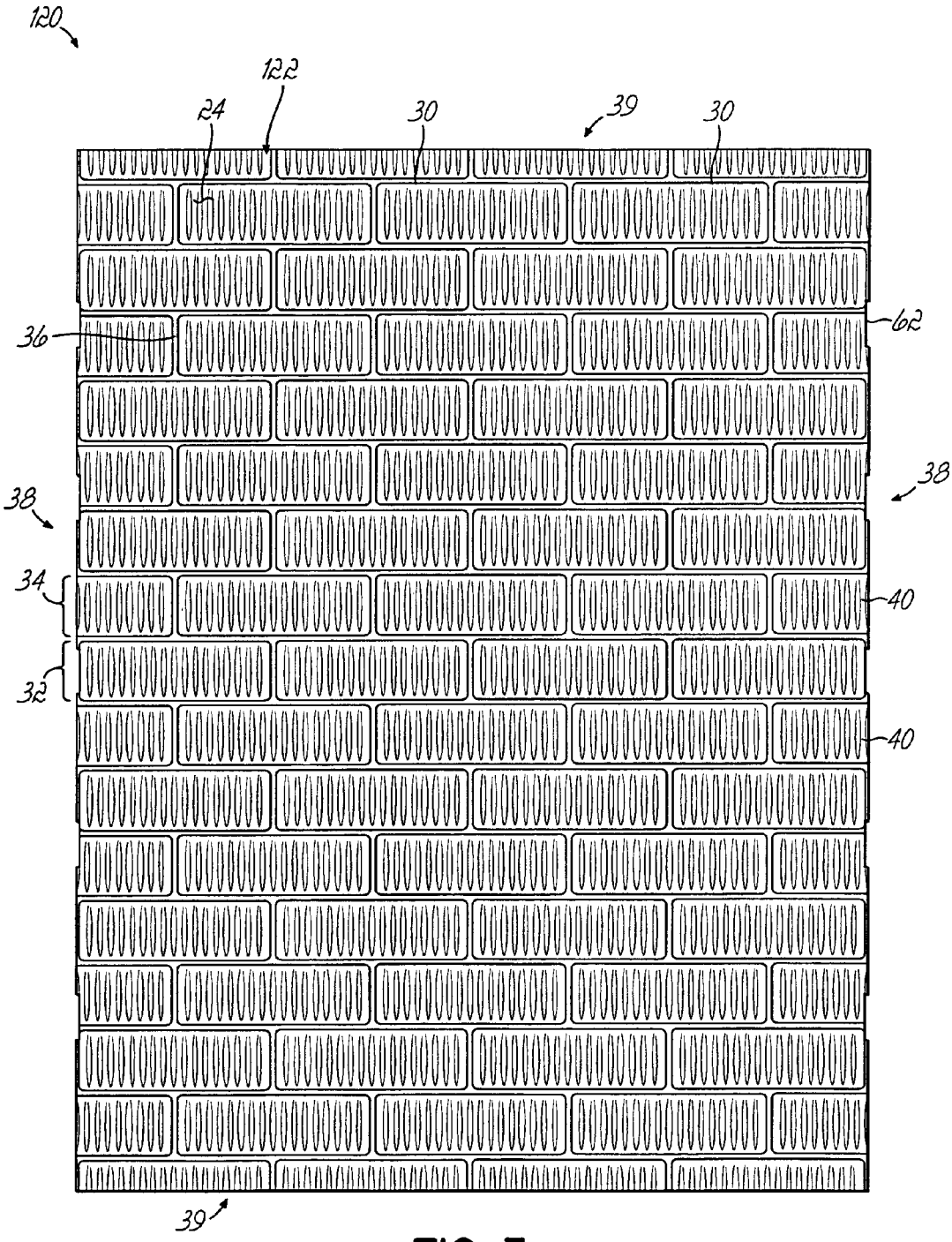
FIG. 3 is a view similar to FIG. 2 of an alternative embodiment of the panel according to this invention.

Referring to the drawings, a wall form panel 20 is illustrated in FIGS. 1–3 and includes a generally rectangular embossed face sheet 22 having a front face 24 for contacting concrete or other poured construction material and an opposed back face 26, and a reinforcing grid 28 secured thereto. While only one panel 20 is illustrated, it is to be understood that a plurality of panels 20 are normally employed in upright, side by side relationship to collectively comprise a form structure for temporarily supporting poured concrete or the like.

The face sheet 22 is generally non-planar and, in one embodiment, is embossed to present a textured brickwork pattern in the back face 26 and an impression of the pattern in the front face 24. The pattern is configured to represent brickwork in an English cross-bond having a plurality of stretchers in the nature of bricks 30 arranged in a number of alternate, horizontally extending courses 32 and 34. A vertically extending joint 36 is disposed between adjacent bricks in the courses 32, 34 with joints 36 in courses 32 being vertically aligned mid-length with bricks 30 in courses 34. A pair of side marginal borders 38 extend along opposed lateral boundaries of the face sheet 22. Likewise, upper and lower borders 39 extend along opposed upper and lower boundaries of the face sheet 22. As shown for example in FIGS. 1–2, the marginal borders 38 traverse courses 32, 34 in alignment with the vertical joints 16 of courses 34 such that a number of half-bricks 40 are presented in courses 32 at the marginal borders 38. It will be understood that the half-bricks in courses 32 ate intended for alignment with similar half-bricks 40 in the face sheet 22 of an adjacent panel 20 when a plurality of the panels 20 are employed in forming a wall or the like.

It is important to note that the textured brick pattern embossed in the face sheet 22 is of a relatively complex nature as evidenced by the numerous indentations and irregularities in the surface thereof. Nevertheless, other patterns representing bricks, stones or any other configuration, in addition to those shown and described herein, are well within the scope of this invention.

Once the face sheets 22 have been formed, for example in a single stamping operation from 5052 aluminum, they are provided with a reinforcing grid 28 as described above to enable the panels to support a volume of poured concrete without buckling under the weight of the concrete. The grid 28 includes a pair of spaced upper and lower flanges 42, 44 welded to the back face 26 of sheet 22 along borders 39. The grid 28 further includes a pair of elongate, spaced, support flanges 46 extending vertically along respective marginal borders 38.

Figure 5:
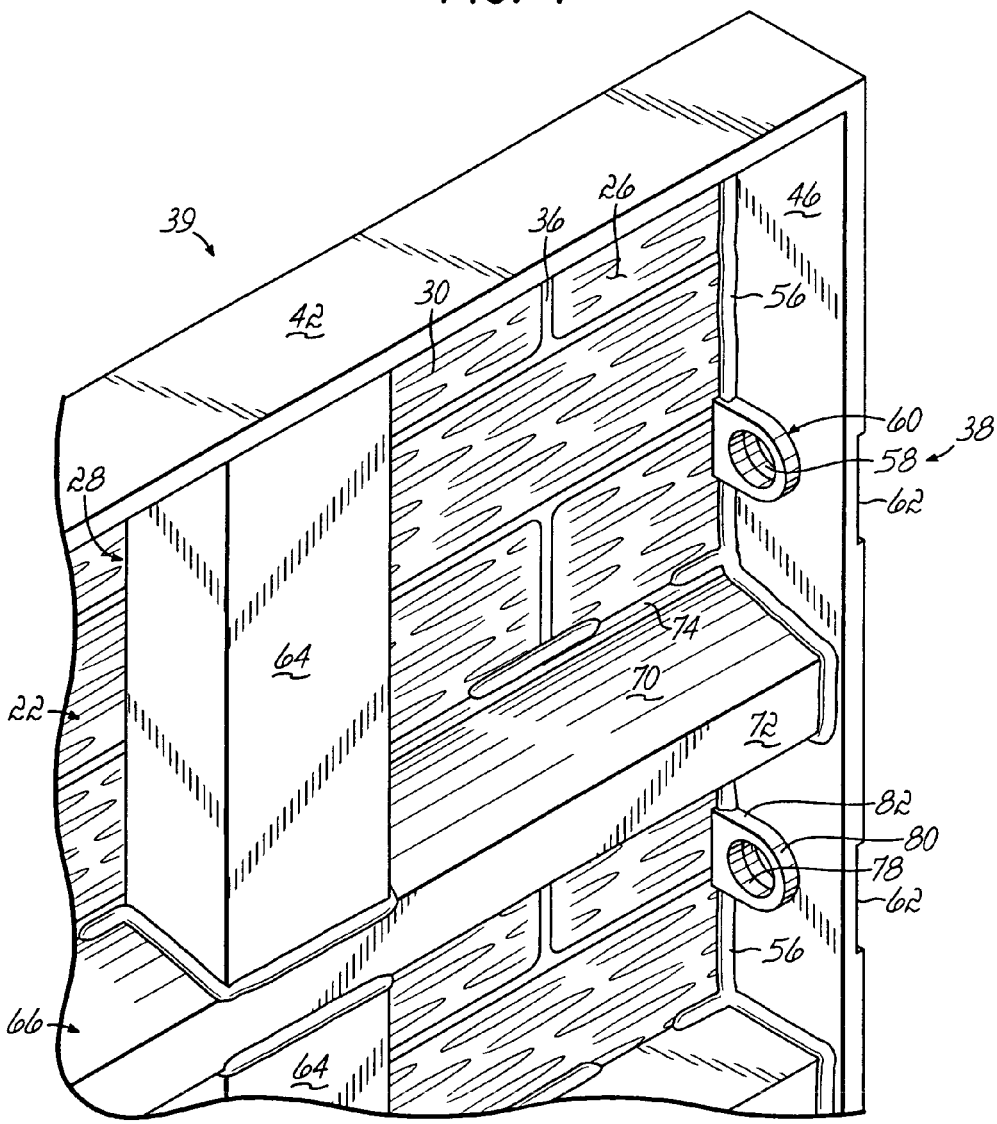
FIG. 5 is a perspective view of a portion of a back side of a panel according to this invention.
Figure 6:
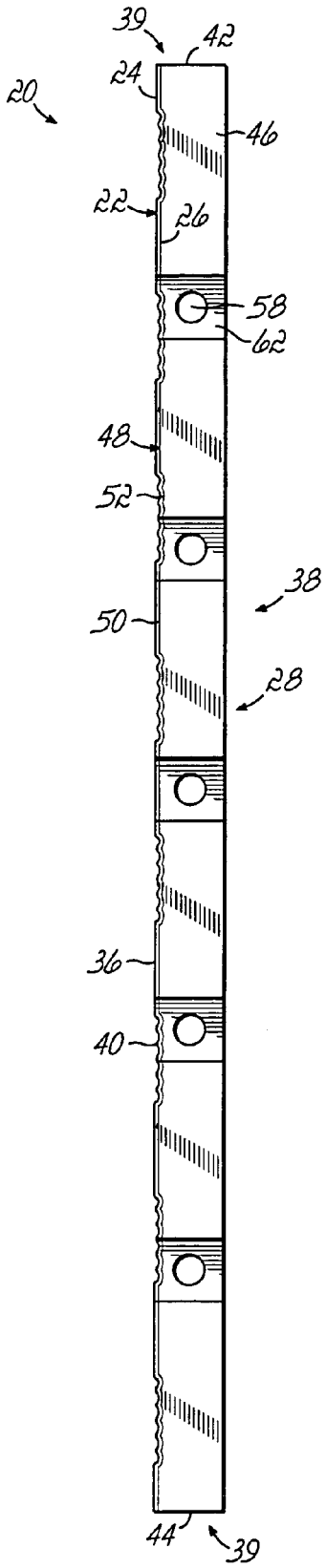
FIG. 6 is a side elevational view of a flange on a panel according to one embodiment of this invention.

As shown in FIGS. 1,5 and 6, each flange 48 includes an elongate surface edge 48 extending along the length of the flange 46 confronting and disposed in securing contact with the back face 26 of the face sheet 22. Surface 48 has a plurality of vertically spaced projections 50 adapted to be received within alternately spaced depressions 52 in marginal borders 38 as presented by joints 16 in courses 34 in relationship to half-bricks 42 of courses 32. Note that the projections 50 in combination with surface 48 assure that the marginal border 38 is firmly and fully supported along its entire length such that the possibility of the border 38 being deformed from its initial configuration is greatly reduced.

Figure 7:
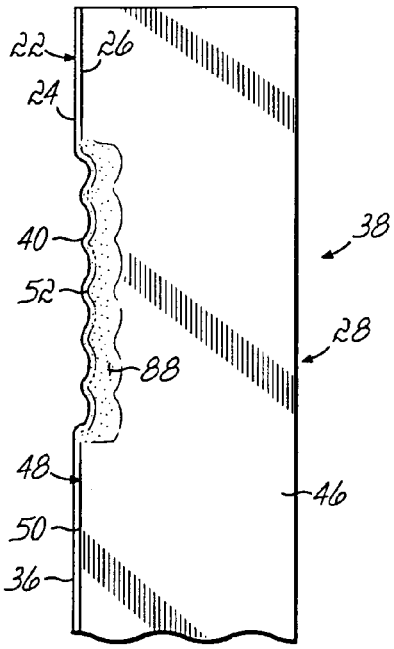
FIG. 7 is an enlarged view of a portion of the side flange of FIG. 6 focusing on a half-brick pattern on the face sheet.

To further enhance the tailored configuration of support flange 46 in relation to the marginal border 38 on the back face 26 or sheet 22, the flange 48 is provided with a plurality of recesses 52 adjacent the bases of projections 50 for abutment against the bricks 30 in courses 34. As such, the flange 46 is optimally configured to assure a desired substantially continuous contact with the face 26 along the border 38. As shown in FIGS. 1 and 5, each flange 46 is secured to sheet 22 by a fillet weld 56 or the like along substantially the entire length of the flange 46 on the interior of the panel 20. Additionally, as shown In FIG. 7, the exterior surface 88 of the flange 46 is preferably welded (i.e., TIG welding, gas tungsten arc welding or other technique) at the depressions 52 on the face sheet 22 representing a half-brick to inhibit separation of the face sheet 22 from the flange 46.

In FIG. 3, a panel 120 is shown constructed substantially the same as panel 20 with the exception that the panel 120 has a face sheet 122 with a vertex brick pattern embossed therein.

As previously described, a plurality of panels 20 or 120 are normally secured together in upright side-by-side relationship for presenting a concrete forming structure. Of course, in this position the front face 24 is adapted to receive the poured concrete such that the pattern impressed in face 24 will ultimately appear on the formed concrete structure.

It is important to understand that the flanges 46 securely support marginal borders 38 and are welded to the face sheet 22 along their full lengths adjacent the interior of the panel (FIG. 5) such that they are at all times protected against undesired deformation. It has been found that panels having only intermittent support and/or welds at the marginal edges thereof become significantly deformed at the edges after only a short period of use. Hence, the present invention provides an inexpensive means for greatly increasing the useful life of embossed panels. In turn, this increased life makes it feasible to produce somewhat more expensive and complex embossed patterns such as textured brick and stone.

A presently preferred embodiment of an attachment system for a poured concrete wall form panel 20 is shown and described in U.S. Pat. Nos. 5,802,795 and 5,904,875, each hereby incorporated by reference. The attachment system includes a pin (not shown) having a generally cylindrical stem having an enlarged disk-shaped head on one end. The shank of the pin is sized for insertion through a hole 58 in the flange 46 of the panel 20 used for constructing a concrete wall form. The hole 58 in the flange 46 is aligned with a similarly configured hole 58 in the flange 46 of an adjacent panel 20. The flange 46 preferably includes a bushing 60 seated in the hole 58 and the diameter of the bushing 60 permits movement of the shank of the pin there through.

Advantageously, the bushing 60 is provided in each of the holes 58 in the side flanges 46 of the panels 20 and the bushing 60 includes a tubular neck 78 seated within the hole 58 and a flared collar 80 which abuts against a base 82 on the inner face of the flange 46 (FIG. 5). The flared collar 80 has a widened flared or tapered base 82 juxtaposed toward the back face 26 of the sheet 22 to provide enhanced load-bearing capabilities in this region. The widened base 82 enhances the load-bearing capability by distributing the load experienced at the juncture between the adjacent panels 20 and the pin across a wider area thereby avoiding a load concentration which may lead to a failure of the various component parts. Another example of a bushing according to this invention is shown in U.S. Pat. No. 6,283,439, incorporated herein by reference.

Figure 8:
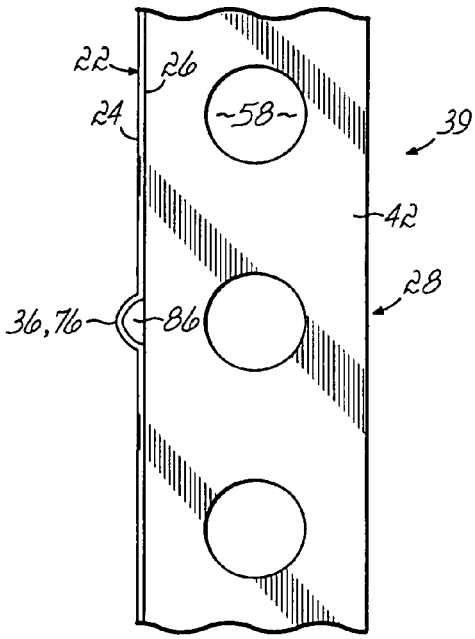
FIG. 8 is a view taken along line 8—8 of FIG. 1 showing a plug in an opening between the face sheet and the reinforcing grid on the panel.

The side flange 46 of each panel 20 includes a plurality of the spaced holes 58 preferably at approximately 12" intervals beginning at 6" from longitudinal top and bottom edges of the panel 20. It will be appreciated by one of ordinary skill in the art that the width dimensions of the panels are exemplary only and should not be considered as a limitation upon this invention. Moreover, the upper and lower flanges 42, 44 may also include holes 58 and bushings 60 as described herein and as shown in FIG. 8.

As is well known in the art, a tie rod (not shown) having a hole proximate an end thereof extends between the adjacent panels 20, 20 of the concrete wall form to maintain the spacing between the opposed panels (not shown) forming a cooperating wall form (not shown). The flanges 46 may include a notch or cut-out 62 sized and configured to accommodate the tie rod seated in the notch 62 so that the flanges 46 of the adjacent panels 20, 20 can be juxtaposed in face-to-face abutting relationship. As is well known, a wedge (not shown) is dimensioned to fit within a slot in the shank of the pin to secure the adjacent panels 20 together.

When the adjacent panels 20, 20 are positioned with the respective holes 58 in the flanges 46 being generally aligned, the pin is projected through the hole 58 in the panel 20. The tie rod (not shown) may then be slipped onto the shank of the pin and then the shank inserted into the hole 58 in the opposite flange 46 at which time the narrow end of the wedge is inserted into the slot and hammered or forced into place thereby drawing the panels 20, 20 together and releasably coupling and binding them together forming a concrete wall form.

Referring to FIGS. 1 and 4–6, each panel 20 includes the reinforcing grid 28 on the back face of the panel 20. Preferably, longitudinally extending vertical beams 64 having a generally rectangular configuration are on the back of the panel 20. The beams 64 are welded, glued or otherwise adhered to the upper and lower flanges 42, 44, but not the face sheet 22. As shown in FIG. 1 and 4–6, the beams 64 may extend continuously between the top and bottom flanges 42, 44 or only intermittently between the flanges 42, 44 and/or lateral struts 66.

An important feature of this aspect of the invention is that the beams 64 are not welded along their length to the face sheet 22. This is shown most clearly in FIG. 5 as the representative portion of the beam 64 extending between the top flange 42 and the strut 66 is not welded to the face sheet 22 or substantially free of weld connections between the longitudinal length of the beam 64 and the face sheet 22. As shown in FIG. 5, the beam 64 is welded to the strut 66 and the top flange 42; however, this invention substantially avoids welding the beam 64 to the face sheet 22 to avoid the blemishes and pock marks on the face sheet 22 which result from the welding process. This offers a more realistic and blemish-free facade to the resulting poured concrete wall surface. Nevertheless, the strength of the panel is maintained and increased because the beams are securely mounted between the upper and lower flanges 42, 44 and the associated struts 66 to transmit the appropriate load and distribute it there between. While the side flanges 46 and the top and bottom flanges 42, 44 are substantially welded along their entire length along the interior of the panel 20 to the face sheet 22, this provides a more robust assembly which is less likely to result in damage or peeling of the face sheet 22 from the reinforcing grid 28. Moreover, such a robust panel 20 is provided without the appearance of blemishes on the face sheet 22 unlike prior panels of this type.

The laterally extending struts 66 preferably having a cross-hat shaped configuration with a wider base 68 adjacent the back face 26 of the sheet 22 and a tapered section 70 joined to a bight 72. The struts 66 are also welded, glued, joined or attached to the back face 26 of the sheet 22. The struts 66 extend preferably the entire width of the panel 20 from side flange 46 to the opposite flange 46. Preferably, the longitudinally extending beams 64 extend from the upper flange 42 to the uppermost strut 66, between each strut 66, and from the lower flange 44 to the lowermost strut 66 to provide enhanced strength and reinforcement to the upper and lowermost regions of the panel 20. The section of the panel 20 which typically experiences the highest loads is the bottom and as a result of the location of the beams 64, the panel 20 is interchangeable from top to bottom for easier installation and use.

Figure 4:
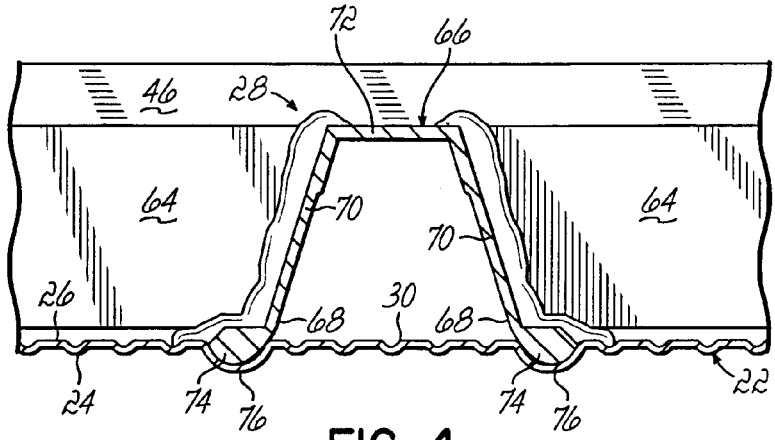
FIG. 4 is a cross-sectional view taken along line 4—4 of FIG. 1.

One aspect of this invention is the configuration and placement of the struts 66 extending laterally across the back surface of each panel 20. Specifically, as shown in FIGS. 1, 4 and 5, the base 68 of each strut 66 has a pair of generally parallel beads 74 which are spaced on a center line approximately 3" apart and advantageously each bead 74 is sized and configured to mate with and be seated within one of the embossed channels 76 in the face sheet 22 representing the mortar joint between the adjacent courses 32, 34 of bricks 30 in the textured brick embossed face sheet 22. Preferably, the beads 74 have the same or complementary shape as the channels 76 to be fully seated therein. This offers a more secure interface between the struts 66 and the face sheet 22 as well as a reduced profile for the panel 20.

The struts 66 may be spot welded or continuously welded along their longitudinal length to the face sheet 22, but this does not present blemishes or pock marks on the face sheet 22 because the beads 74 of the struts 66 are seated within the mortar joint sections 76 of the face sheet 22 thereby concealing any resulting blemishes or pock marks. The beads 74 of the struts 66 are welded to the face sheets 22; however, the welding process does not produce blemishes in the face sheet 22 that generate pock marks or other undesirable blemishes on the poured concrete wall facade because of their placement in the channels 76 along the representative mortar joints of the brickwork facade. Likewise, positioning the beads 74 of the struts 66 within the channels 76 representing the mortar joints allows for increased strength of the panel 20 while minimizing the profile. In other words, since the struts 66 are seated within the channels 76 representing the mortar joints, the present invention provides the advantages of a blemish free brickwork facade structurally robust panel in a low prof ire configuration. Alternatively, the width of each strut may be 6" to span a pair of brickwork courses 32, 34 or another integral number of bricks 30 as is readily appreciated by those of ordinary skill in this art.

Another feature of the panel 20 according to this invention is shown in FIG. 8. Specifically, due to the textured configuration of the face sheet 22 and, in particular, the indentations and irregularities in the non-planar surface of the face sheet 22, openings, pockets, channels or grooves formed in the face sheet 22 adjacent the marginal edges of the flanges 42, 44, 46 are present. For example, the textured brickwork pattern in the face sheet 22 includes channel joints 36 or 76 disposed between adjacent bricks 30. The intersection of the joints with the flanges 42, 44, 46 presents openings, channels or grooves into which concrete may be splashed, poured or otherwise embedded. When such concrete cures and hardens, a significant amount of weight is added to the panel 20 and the face sheet 22 may separate from the reinforcing grid 28 thereby damaging the panel 20. To alleviate this problem, this invention fills such gaps, openings and channels between the grid 28 and the face sheet 22 along the marginal edges. In one embodiment, a plug 86 is inserted into the mortar joint channel 36, 76 to prevent the entry of foreign matter, debris, mortar or other material therein.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A concrete wall form panel comprising:

a generally rectangular, non-planar, textured face sheet having a back face and an opposed front face with a pattern thereon adapted to be juxtaposed to liquid concrete and form a representation of the pattern in the concrete, the face sheet having a longitudinal major dimension and a lateral minor dimension;

a pair of spaced side flanges each welded along substantially its entire length to the back face of the face sheet along a side edge of the face sheet, each side flange having a front edge juxtaposed to the back face of the face sheet;

an upper and a lower flange extending between the spaced side flanges proximate the upper and lower edges, respectively, of the face sheet and projecting rearwardly from the back face of the face sheet;

at least one beam extending longitudinally on the back face of the face sheet, generally parallel to and interposed between the side flanges;

wherein each beam is welded to at least one of the upper and lower flanges but not directly to the face sheet to thereby avoid blemishes on the face sheet;

a plurality of holes in each of the side flanges; and a bushing in each hole having a flared base juxtaposed toward the face sheet to provide enhanced load bearing capabilities.

2. The wall form panel of claim 1 wherein the face sheet is metal.

3. The wall form panel of claim 1 wherein the upper and lower flanges are each welded along substantially its entire length to the back face of the face sheet.

4. The wall form panel of claim 1 further comprising:

at least one strut extending between the side flanges substantially the full extent of the minor dimension of the panel and projecting rearwardly from the face sheet.

5. The wall form panel of claim 4 wherein each beam is welded to the upper and lower flanges and to each strut.

6. The wall form panel of claim 1 further comprising a plurality of the beams spaced laterally across the minor dimension of the panel.

7. The wall form panel of claim 1 wherein each beam has a generally rectangular cross-sectional configuration.

8. A concrete wall form panel comprising:

a generally rectangular, non-planar, textured face sheet having a back face and an opposed front face with a simulated brick pattern thereon adapted to be juxtaposed to liquid concrete and form a representation of the brick pattern in the concrete, the face sheet having a longitudinal major dimension and a lateral minor dimension, the simulated brick pattern including an array of simulated bricks arranged in laterally extending courses and each course is separated from an adjacent course by a simulated mortar joint having a mortar joint configuration;

a pair of spaced side flanges each mounted to the back face of the face sheet along a side edge of the face sheet;

an upper and a lower flange each mounted to the back face of the face sheet along the upper and lower edges, respectively, of the face sheet; and at least one strut extending between the side flanges substantially the full extent of the minor dimension of the panel, each strut having at least one terminal edge seated within one of the simulated mortar joints in the face sheet, a configuration of the terminal edge being similar to that of the mortar joint configuration for mating engagement therewith.

9. The wall form panel of claim 8 wherein the terminal edge configuration is convex and the mortar joint configuration is concave.

10. The wall form panel of claim 8 further comprising:

a convex bead on the terminal edge of each strut.

11. The wall form panel of claim 8 wherein each strut includes a pair of spaced legs each having one of the terminal edges further comprising a convex bead and each of the convex beads are seated within adjacent concave shaped simulated mortar joints in the face sheet.

12. The wall form panel of claim 8 wherein each terminal edge is welded to the face sheet in the associated simulated mortar joint.

13. A concrete wall form panel comprising:

a generally rectangular, non-planar, textured face sheet having a back face and an opposed front face with a pattern thereon adapted to be juxtaposed to liquid concrete and form a representation of the pattern in the concrete;

a pair of spaced side flanges each mounted to the back face of the face sheet along a side edge of the face sheet;

an upper and a lower flange each mounted to the back face of the face sheet along the upper and lower edges, respectively, of the face sheet;

a gap between the face sheet and an adjacent one of the flanges; and a plug inserted into the gap to inhibit liquid concrete from entering the gap.

14. The wall form panel of claim 13 wherein the gap is located at a perimeter of the face sheet.

15. The wall form panel of claim 13 wherein the pattern on the face sheet further comprises a simulated brick pattern including an array of simulated bricks and each brick is separated from an adjacent brick by a simulated mortar joint and the gap is one of the simulated mortar joints.

16. The wall form panel of claim 13 wherein the plug is not integral with the flange adjacent to the gap.

17. The wall from panel of claim 13 wherein the gap and associated plug is located adjacent one of the upper and lower flanges.

18. A concrete wall form panel comprising:

a generally rectangular, non-planar, textured face sheet having a back face and an opposed front face with a pattern thereon adapted to be juxtaposed to liquid concrete and form a representation of the pattern in the concrete;

a pair of spaced side flanges each mounted to the back face of the face sheet along a side edge of the face sheet;

an upper and a lower flange each mounted to the back face of the face sheet along the upper and lower edges, respectively, of the face sheet;

a gap between the face sheet and an adjacent one of the flanges;

a plug inserted into the gap to inhibit liquid concrete from entering the gap;

wherein the pattern on the face sheet further comprises a simulated brick pattern including an array of simulated bricks and each brick is separated from an adjacent brick by a simulated mortar joint and the gap is one of the simulated mortar joints; and at least one strut extending between the side flanges generally parallel to and interposed between the upper and lower flanges, each strut having at least one terminal edge seated within one of the simulated mortar joints in the face sheet, a configuration of the terminal edge being similar to that of the mortar joint for mating engagement therewith.

19. The wall form panel of claim 18 further comprising:

at least one beam extending longitudinally on the back face of the face sheet, generally parallel to and interposed between the side flanges;

wherein each beam is welded to at least one of the upper and lower flanges but not directly to the face sheet to thereby avoid blemishes on the face sheet.

20. The wall form panel of claim 19 further comprising:

a plurality of holes in each of the side flanges; and a bushing in each hole having a flared base juxtaposed toward the face sheet to provide enhanced load bearing capabilities.

21. The wall form panel of claim 20 further comprising a plurality of the beams and a plurality of the struts.

* * * * *

UNITED STATES PATENT AND TRADEMARK OFFICE

CERTIFICATE OF CORRECTION

PATENT NO. : 6,991,205 B2 
DATED : January 31, 2006
INVENTOR(S) : Dallas E. Myers and James W. Jackson It is certified that error appears in the above-identified patent and that said Letters Patent is hereby corrected as shown below:

Column 4,
Line 16, "FIGS. 1-3" should read -- FIGS. 1-2 --.
Line 43, "32 ate intended" should read -- 32 are intended --.
Line 64, "flange 48 includes" should read -- flange 46 includes --.

Column 5,
Line 11, "26 or sheet" should read -- 26 of sheet --.
Line 19, "shown In FIG." should read -- shown in FIG. --.

Column 7,
Line 54, "low prof ire configuration" should read -- low profile configuration --.

Signed and Sealed this

Sixth Day of June, 2006

JON W. DUDAS
*Director of the United States Patent and Trademark Office*